US009937989B2

(12) United States Patent
Kumita

(10) Patent No.: US 9,937,989 B2
(45) Date of Patent: Apr. 10, 2018

(54) OUTBOARD MOTOR

(71) Applicant: YAMAHA HATSUDOKI KABUSHIKI KAISHA, Iwata-shi, Shizuoka (JP)

(72) Inventor: Atsushi Kumita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/299,736

(22) Filed: Oct. 21, 2016

(65) Prior Publication Data

US 2017/0113772 A1 Apr. 27, 2017

(30) Foreign Application Priority Data

Oct. 27, 2015 (JP) ..... 2015-210877

(51) Int. Cl.
*B63H 20/00* (2006.01)
*B63H 20/10* (2006.01)
*B63H 20/32* (2006.01)

(52) U.S. Cl.
CPC ..... *B63H 20/002* (2013.01); *B63H 20/10* (2013.01); *B63H 20/32* (2013.01)

(58) Field of Classification Search
CPC ..... B63H 20/00; B63H 20/002; B63H 20/32; B63H 20/10; B63H 20/14; B63H 21/38; B63H 21/10; B63H 21/12; B63H 21/00; B63H 21/28
USPC ..... 440/75, 77, 88 L
See application file for complete search history.

(56) References Cited

U.S. PATENT DOCUMENTS 7,182,658 B2 * 2/2007 Asakaze ..... B63H 21/38 440/75

FOREIGN PATENT DOCUMENTS

JP 2007-245789 A 9/2007

* cited by examiner

*Primary Examiner* — Lars A Olson
(74) *Attorney, Agent, or Firm* — Keating and Bennett, LLP

(57) ABSTRACT

An outboard motor includes an engine housed in a cowling and disposed above an upper case housing a driveshaft. A gear mechanism transmits a rotation of the driveshaft to a propeller shaft housed in a lower case disposed below the upper case. The gear mechanism is housed in an oil storage chamber of the lower case and is lubricated by a lubricating oil inside the oil storage chamber. An oil passage includes a lower oil port opening at the oil storage chamber, an upper oil port positioned higher than the lower case, and a longitudinal passage extending in an up/down direction inside the lower case.

16 Claims, 7 Drawing Sheets

1

OUTBOARD MOTOR

BACKGROUND OF THE INVENTION

1. Field of the Invention

The present invention relates to an outboard motor.

2. Description of the Related Art

JP 2007-245789 A discloses a gear oil exchange method to exchange a gear oil of an outboard motor or other propulsion device without bringing a vessel that includes the propulsion device ashore.

With this method, first and second oil ports that are disposed underwater are moved to above a water surface by tilting up the propulsion device. In this state, first and second plugs mounted to the first and second oil ports are removed and first and second adapters are mounted to the first and second oil ports. Further, one end of first and second hoses are mounted to the first and second adapters, and another end of the first hose is mounted to a suction pump disposed on board. Another end of the second hose is open to atmosphere. In this state, the propulsion device is tilted down and the gear oil inside the propulsion device is suctioned by the suction pump.

After the used gear oil has been discharged, the other end of the first hose is removed from the suction pump and mounted to an oil tank disposed on board. Further, the other end of the second hose is mounted to the suction pump. In this state, the fresh gear oil inside the oil tank is fed into the propulsion device using the suction force of the suction pump. After a prescribed amount of the gear oil has been supplied, the propulsion device is tilted up. In this state, the first and second adapters are removed from the first and second oil ports and the first and second plugs are mounted to the first and second oil ports. Thereafter, the propulsion device is tilted down.

The exchange of lubricating oil that lubricates a gear mechanism, etc., of an outboard motor is ordinarily performed in a state in which a vessel has been brought ashore. However, due to an increase in the size of vessels, vessels are increasingly stored on the water without being brought ashore. It is thus preferable that it be possible to perform the exchange of lubricating oil without bringing a vessel, including an outboard motor, ashore.

JP 2007-245789 A discloses a gear oil exchange method to exchange the gear oil of the propulsion device without bringing the vessel ashore. However, with this method, the first and second oil ports, at which the mounting and removal of the first and second adapters, etc., are performed, are located away from a hull and it is thus difficult for a user to perform the mounting and removal processes on board. Although it may be possible to access the first and second oil ports from a pier or other location besides the vessel, the operations of tilting up and tilting down the propulsion device, etc., must be performed on board and therefore the user must go back and forth between the vessel and its surroundings.

SUMMARY OF THE INVENTION

In order to overcome the previously unrecognized and unsolved challenges described above, a preferred embodiment of the present invention provides an outboard motor including an engine, a driveshaft extending in an up/down direction below the engine and to which a rotation of the engine is transmitted, a gear mechanism coupled to a lower end portion of the driveshaft and to which a rotation of the driveshaft is transmitted, a propeller shaft to which a rotation of the gear mechanism is transmitted, a cowling housing the engine, an upper case disposed below the engine and housing the driveshaft, a lower case defining an oil storage chamber housing the gear mechanism and a lubricating oil and disposed below the upper case, and an oil passage including a lower oil port opening at the oil storage chamber, an upper oil port positioned higher than the lower case, and a longitudinal passage extending in the up/down direction inside the lower case, and guiding the lubricating oil between the lower oil port and the upper oil port.

With the present arrangement, the rotation of the engine is transmitted to the propeller via the driveshaft, the gear mechanism, and the propeller shaft. The engine housed in the cowling is disposed above the upper case that houses the driveshaft. The gear mechanism that transmits the rotation of the driveshaft to the propeller shaft is housed in the lower case disposed below the upper case. The gear mechanism housed in the oil storage chamber of the lower case is lubricated by the lubricating oil inside the oil storage chamber.

The lower oil port of the oil passage opens at the oil storage chamber. The upper oil port of the oil passage is disposed higher than the lower case. When the lubricating oil inside the oil storage chamber is to be discharged, a suction pump is connected to the upper oil port. The lubricating oil inside the oil storage chamber is made to flow, by the suction force of the suction pump, from the lower oil port to the upper oil port via the longitudinal passage extending in the up/down direction inside the lower case. The lubricating oil inside the oil storage chamber is thus discharged.

The upper oil port is disposed higher than the lower case and therefore, in comparison to a case where it is provided at the lower case, the upper oil port is arranged closer to the engine. In other words, the upper oil port is arranged closer to a user on board the vessel. The user is thus able to connect the suction pump to the upper oil port without disembarking from the vessel. The user is thus able to exchange the lubricating oil inside the outboard motor included in the vessel without disembarking from the vessel afloat on a water surface.

The upper oil port is preferably disposed higher than the upper case.

With the present arrangement, the upper oil port of the oil passage is disposed higher than an upper end of the upper case and therefore the upper oil port is arranged even closer to the user on board. The upper end of the upper case is ordinarily positioned above the water surface. The upper oil port is thus ordinarily disposed above the water surface. A user on board is thus able to access the upper oil port easily without putting his/her hand underwater.

The outboard motor is preferably rotatable around a horizontally-extending tilting shaft. The upper oil port is preferably positioned higher than the tilting shaft.

With the present arrangement, the upper oil port of the oil passage is disposed higher than the tilting shaft and therefore the upper oil port is arranged even closer to the user on board. The tilting shaft is ordinarily positioned higher than an upper end of a transom provided at a rear portion of the hull. The upper oil port is thus disposed higher than the upper end of the transom. The user on board is thus able to access the upper oil port easily without lowering his/her hand to a position lower than the upper end of the transom.

The upper oil port is preferably positioned inside the cowling.

With the present arrangement, not only the engine but the upper oil port is also housed in the cowling. The user on board is able to access the upper oil port easily by opening the cowling. Further, when the cowling is closed, the upper oil port is protected by the cowling, so that water spray is unlikely to adhere to the upper oil port. The upper oil port is thus prevented from being soiled with brine, dust, etc.

The upper oil port is preferably positioned rearward of a front end of the cowling.

With the present arrangement, the upper oil port is positioned farther to the rear than the front end of the cowling, that is, farther rearward of a front end of the outboard motor. When the upper oil port is positioned farther to the front than the front end of the outboard motor, a portion of the oil passage is disposed on board. This means that the on board space usable by the user is decreased. Decrease of the on board space is thus prevented by positioning the upper oil port farther to the rear than the front end of the cowling.

The outboard motor is preferably rotatable around the horizontally-extending tilting shaft between a tilt-down position at which the lower case is positioned underwater and a tilt-up position at which the lower case is positioned above the water surface. The lower oil port may be positioned at or adjacent to a lowermost end of the oil storage chamber when the outboard motor is positioned at the tilt-up position.

With the present arrangement, when the outboard motor is tilted up to the tilt-up position, that is, when the lower case is disposed above the water surface, the lower oil port is disposed at or in a vicinity of the lowermost end of the oil storage chamber. All of the lubricating oil inside the oil storage chamber flows toward the lowermost end of the oil storage chamber due to gravity. A residual amount of the lubricating oil when the lubricating oil is discharged from the oil storage chamber is thus reduced.

The oil passage may include an integral portion that is integral and unitary with the lower case. The entire oil passage may be the integral portion, or the oil passage may include a separate portion that is separate from the lower case in addition to the integral portion. Alternatively, the entire oil passage may be the separate portion that is separate from the lower case.

At least a portion of the oil passage preferably includes an oil hose. The oil hose may be a flexible member made from an elastic material, such as resin or rubber.

The oil hose is preferably exposed at an outer surface of the upper case.

With the present arrangement, at least a portion of the oil hose is disposed outside the upper case. A space to house the oil hose thus does not have to be provided in an interior of the upper case. Further, at least a portion of the upper case is disposed above the water surface, so that the oil hose is exposed at the outer surface of the upper case while preventing an increase in the resistance applied to the outboard motor from the water.

The outboard motor preferably further includes an oil hose holder that holds the oil hose at the outer surface of the upper case.

With the present arrangement, the oil hose is held at the outer surface of the upper case by the oil hose holder. The position of the oil hose is thus stabilized. The oil hose is thus prevented from rubbing or colliding against another member when the vessel is traveling. Damaging of the oil hose, which is softer than the upper case that is typically made of metal, is thus prevented.

The oil hose holder is preferably positioned on a lateral side of a center of the outboard motor in a right/left direction. In this case, the outboard motor preferably further includes an air hose holder that holds an air hose, which defines an air passage, at the outer surface of the upper case. The air hose holder may be disposed at the same side as the oil hose holder with respect to the center of the outboard motor in the right/left direction or may be disposed at an opposite side.

The outboard motor preferably further includes an apron that covers the outer surface of the upper case. The oil hose is preferably positioned between the outer surface of the upper case and an inner surface of the apron.

With the present arrangement, the oil hose is disposed between the upper case and the apron, so that the oil hose is covered by the inner surface of the apron. The oil hose is prevented from being hit by an obstacle on the water surface or underwater because the oil hose is protected by the apron. Damage to the oil hose is thus prevented.

The outboard motor preferably further includes an air passage that includes a lower air port, positioned higher than the lower oil port and opening at the oil storage chamber, and an upper air port, positioned higher than the lower case, and guides air between the lower air port and the upper air port.

With the present arrangement, not only the lower oil port but the lower air port also opens at the oil storage chamber. When the lubricating oil inside the oil storage chamber is to be discharged, air flowing into the air passage from the upper air port is supplied from the lower air port to the oil storage chamber at the same time as the lubricating oil is suctioned into the oil passage from the lower oil port. When the lubricating oil is to be supplied to the oil storage chamber, the air inside the oil storage chamber is discharged into the air passage from the lower air port at the same time as the lubricating oil is supplied to the oil storage chamber from the lower oil port.

The lower air port is positioned higher than the lower oil port. The lubricating oil is heavier than air and therefore moves downward in the oil storage chamber. The lower air port is thus unlikely to be clogged by the lubricating oil. Therefore, it is unlikely for the entry and exit of air with respect to the lower air port to be obstructed by the lubricating oil. Further, the upper air port is positioned higher than the lower case and the upper air port is thus closer to the user on board. The user thus operates an air cock that opens and closes the upper air port without disembarking from the vessel afloat on the water surface.

The lower air port is preferably positioned farther to the rear of the outboard motor than the lower oil port.

At least a portion of the air passage preferably includes an air hose. The air hose may be a flexible member made from an elastic material, such as resin or rubber, etc.

The air hose is preferably exposed at the outer surface of the upper case.

With the present arrangement, the air hose is disposed on the outer surface of the upper case. In other words, at least a portion of the air hose is disposed outside the upper case. A space to house the air hose thus does not have to be provided in the interior of the upper case. Further, at least a portion of the upper case is disposed above the water surface, so that the air hose is exposed at the outer surface of the upper case while preventing an increase in the resistance applied to the outboard motor from the water.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Unless noted in particular otherwise, an outboard motor 2 in a reference orientation shall be described below. The reference orientation is an orientation where a rotational axis Ac of an engine 3 extends vertically and a rotational axis Ap of a propeller shaft 7 orthogonal or substantially orthogonal to the rotational axis Ac of the engine 3 extends horizontally in a front/rear direction. A center WO of the outboard motor 2 in the right/left direction (see FIG. 5) refers to a vertical plane that includes the rotational axis Ac of the engine 3 and the rotational axis Ap of the propeller shaft 7.

Figure 1:
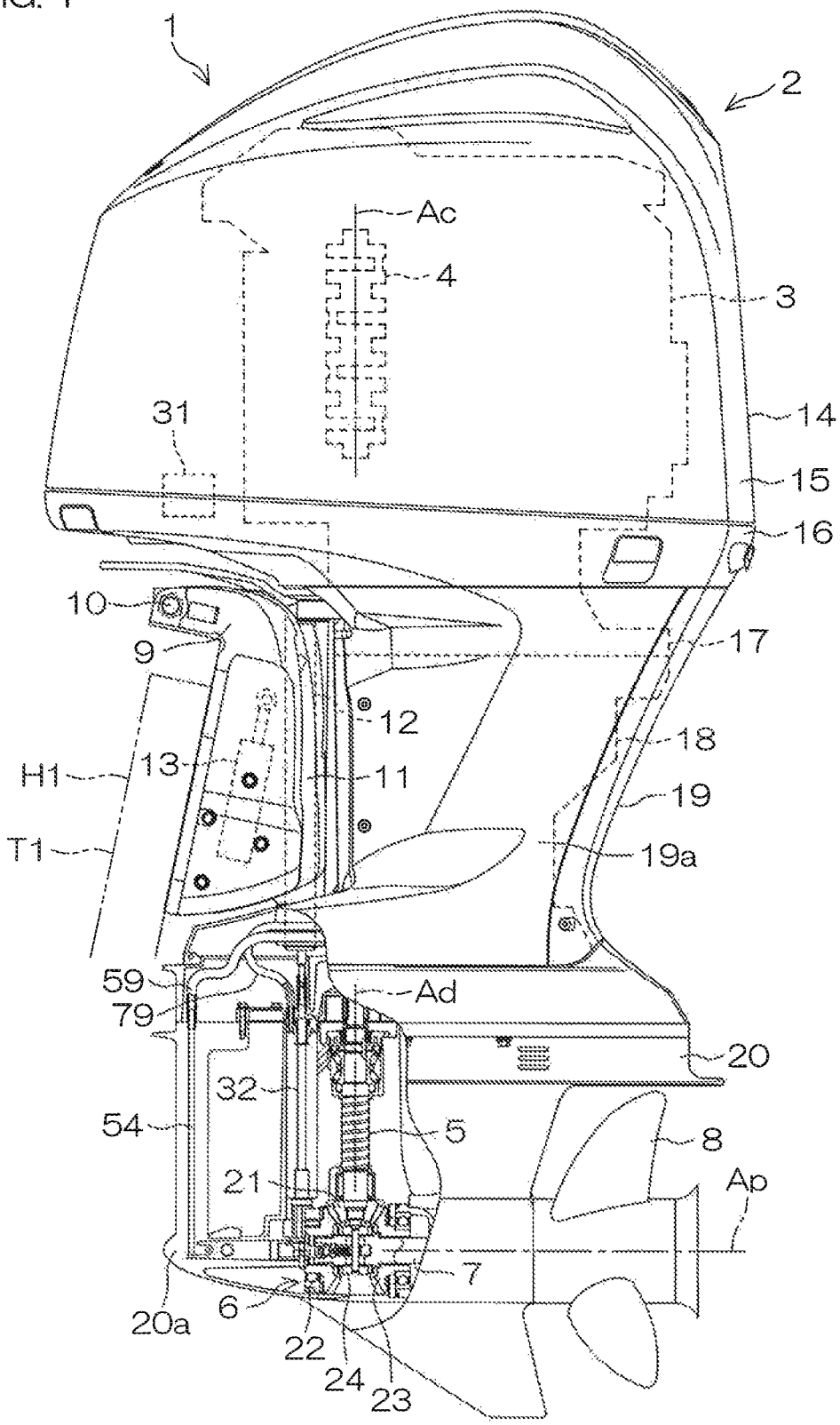
FIG. 1 is a partial sectional view of a left side of an outboard motor according to a preferred embodiment of the present invention.
Figure 2:
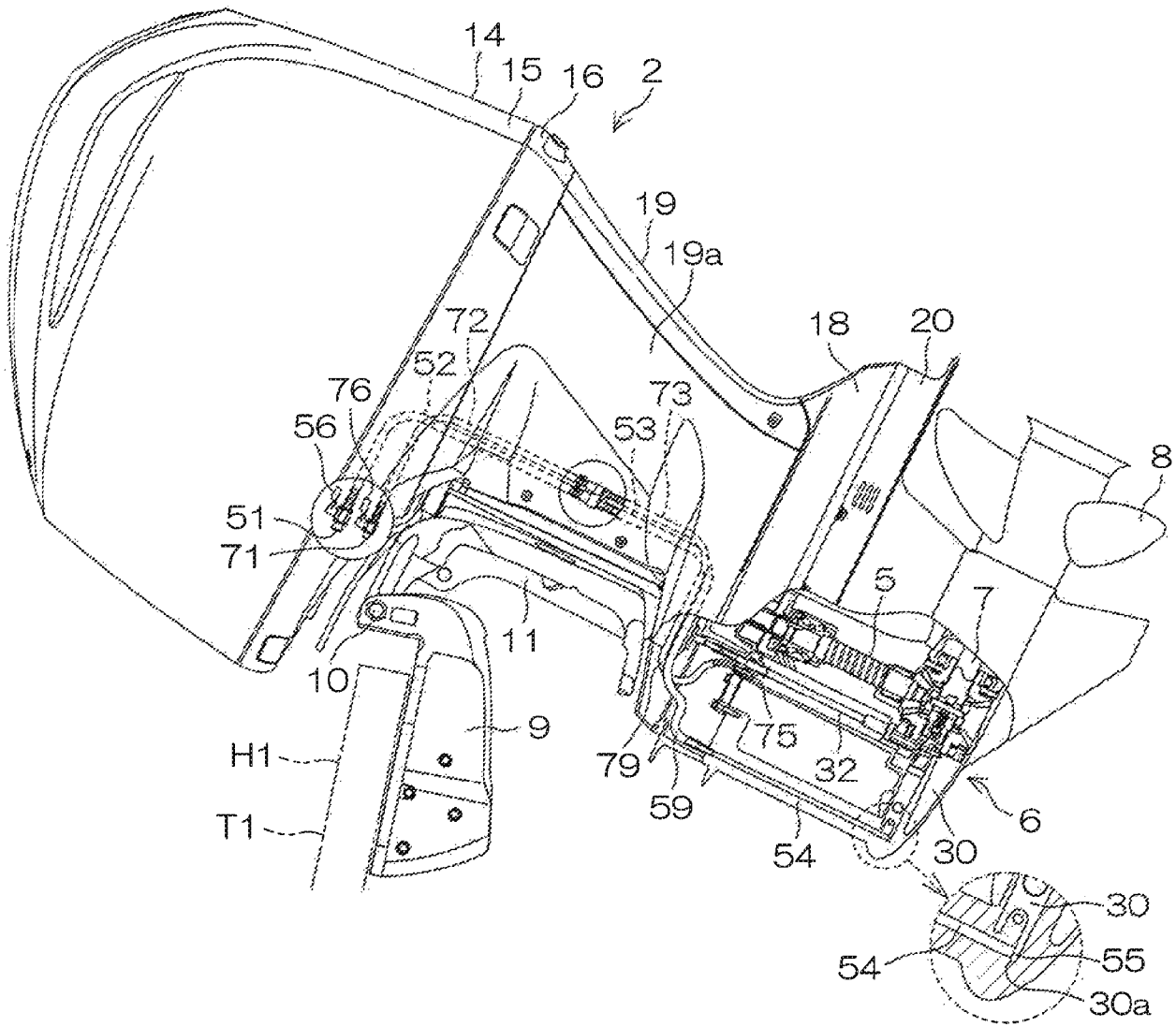
FIG. 2 is a partial sectional view of a state in which the outboard motor is positioned at a tilt-up position.
Figure 3:
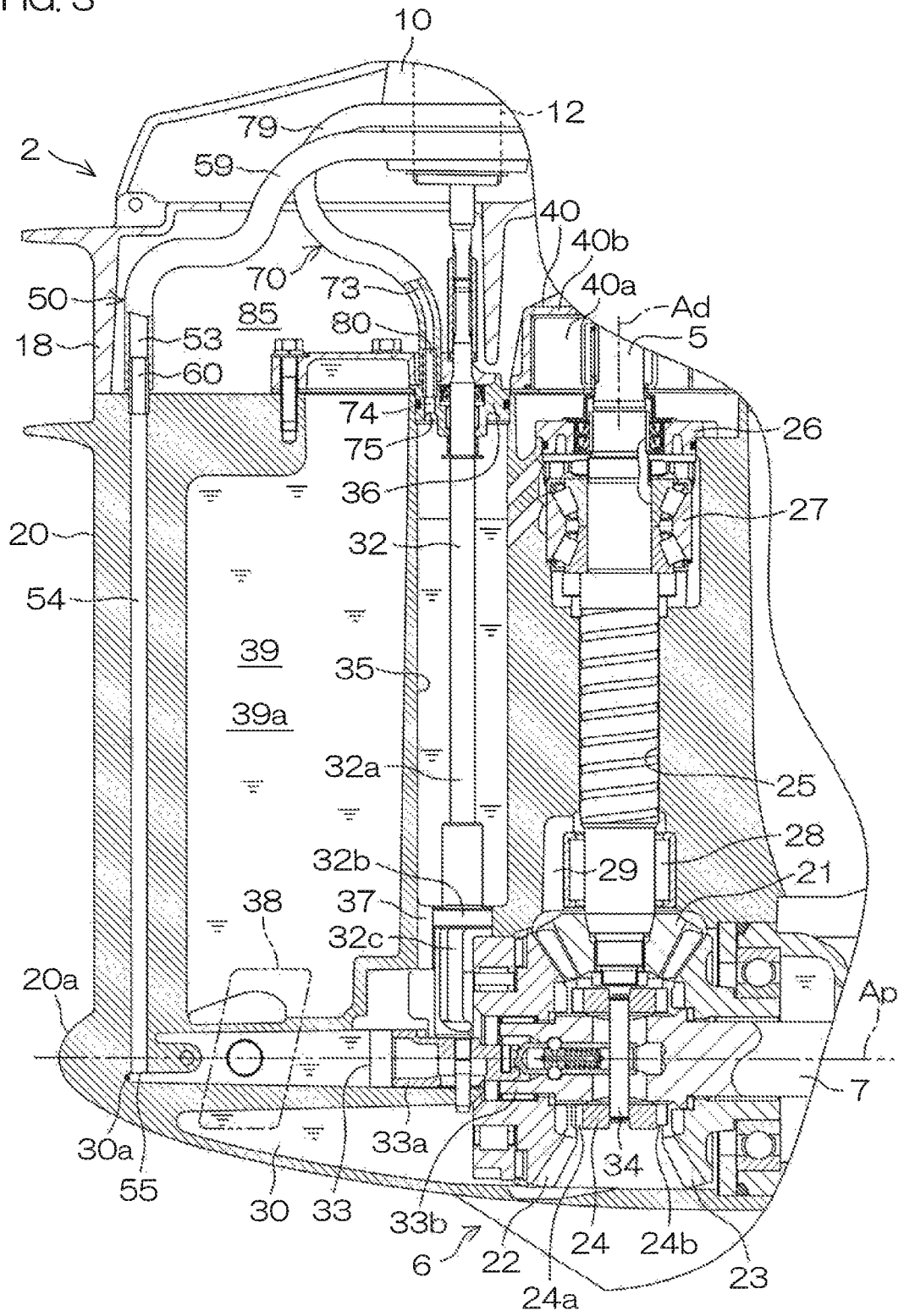
FIG. 3 is an enlarged sectional view of a portion of FIG. 1.

FIG. 1 is a partial sectional view of a left side of the outboard motor 2 according to a preferred embodiment of the present invention. FIG. 1 shows a state in which the outboard motor 2 is in the reference orientation. FIG. 2 is a partial sectional view of a state in which the outboard motor 2 is positioned at a tilt-up position. FIG. 3 is an enlarged sectional view of a portion of FIG. 1.

As shown in FIG. 1, a vessel propulsion device 1 includes the outboard motor 2 that generates a thrust that propels a vessel, and a suspension system mounting the outboard motor 2 to a hull H1.

The outboard motor 2 includes an engine 3, which is an example of a prime mover that generates motive power to rotate a propeller 8, and a power transmission, which transmits the motive power of the engine 3 to the propeller 8. Rotation of a crankshaft 4 included in the engine 3 is transmitted to the propeller 8 via a driveshaft 5, a gear mechanism 6, and a propeller shaft 7 of the power transmission. The propeller 8 is thus made to rotate together with the propeller shaft 7 to generate a thrust that propels a vessel forward or rearward.

The suspension system includes a pair of clamp brackets 9, fixed to a transom T1 provided at a rear portion of the hull H1, and a tilting shaft 10, supported by the pair of clamp brackets 9 in an orientation of extending horizontally in the right/left direction. The suspension system further includes a swivel bracket 11 supported by the pair of clamp brackets 9 via the tilting shaft 10, and a steering shaft 12 supported by the swivel bracket 11 in an orientation of extending vertically in an up/down direction.

The outboard motor 2 is coupled to an upper end portion and a lower end portion of the steering shaft 12. The steering shaft 12 is rotatable with respect to the swivel bracket 11 around a center line of the steering shaft 12 that extends in the up/down direction. The swivel bracket 11 is rotatable with respect to the clamp brackets 9 around a center line of the tilting shaft 10 that extends in the right/left direction. The outboard motor 2 is rotatable in the right/left direction with respect to the hull H1 and is rotatable in the up/down direction with respect to the hull H1.

The vessel propulsion device 1 includes a steering mechanism pivoting the outboard motor 2 around the center line of the steering shaft 12 with respect to the clamp brackets 9, and a power trim and tilt mechanism (hereinafter referred to as "PTT") pivoting the outboard motor 2 around the tilting shaft 10 with respect to the clamp brackets 9. A hydraulic cylinder 13 of the PTT is disposed between the pair of clamp brackets 9. The PTT positions the outboard motor 2 at any position from a tilt-down position (position shown in FIG. 1) at which the propeller 8 is positioned underwater to a tilt-up position (position shown in FIG. 2) at which the propeller 8 is positioned above a water surface.

The outboard motor 2 includes a cowling 14 housing the engine 3 and a casing housing the power transmission. The casing includes an exhaust guide 17 disposed below the engine 3, an upper case 18 disposed below the exhaust guide 17, an apron 19 disposed around the upper case 18, and a lower case 20 disposed below the upper case 18. The cowling 14 includes a cylindrical or substantially cylindrical bottom cowling 16 disposed on the exhaust guide 17, and a cup-shaped top cowling 15 disposed on the bottom cowling 16.

The top cowling 15 and the bottom cowling 16 define a housing space that houses the engine 3. The bottom cowling 16 is disposed around a lower portion of the engine 3. The bottom cowling 16 is removably mounted to the exhaust guide 17. The top cowling 15 is removably mounted to the bottom cowling 16. When the top cowling 15 is removed, the cowling 14 opens and the engine 3 is exposed. The top cowling 15 is removed when performing a process of maintenance, etc. The top cowling 15 may be a single, integral member or may include a plurality of members.

The apron 19 includes two side aprons 19*a*, respectively disposed to the right and to the left of the upper case 18. Each side apron 19*a* is removably mounted to the upper case 18. Upper edges of the side aprons 19*a* are disposed below the cowling 14. The lower case 20 is disposed lower than lower edges of the side aprons 19*a*. The lower case 20 includes a circular or substantially circular cylindrical torpedo portion 20*a* extending in the front/rear direction. The torpedo portion 20*a* is a portion that is disposed underwater. The torpedo portion 20*a* includes a closed front end, a rearwardly open rear end, and a tapered outer surface that narrows as the front end is approached.

The driveshaft 5 extends in the up/down direction inside the exhaust guide 17, the upper case 18, and the lower case 20. The gear mechanism 6 is coupled to a lower end portion of the driveshaft 5. The propeller shaft 7 extends in the front/rear direction inside the torpedo portion 20*a*. The gear mechanism 6 is coupled to a front end portion of the propeller shaft 7. The propeller 8 is removably mounted to a rear end portion of the propeller shaft 7 that projects rearward from a rear end of the torpedo portion 20*a*. The driveshaft 5 is rotatable with respect to the casing around a center line (drive axis Ad) of the driveshaft 5. The propeller shaft 7 is rotatable with respect to the casing around a center line (propeller axis Ap) of the propeller shaft 7.

The engine 3 is, for example, an internal combustion engine. The engine 3 is disposed on the exhaust guide 17 defining an engine supporting member in an orientation where the rotational axis Ac of the crankshaft 4 is vertical or substantially vertical. A direction of the rotation transmitted from the driveshaft 5 to the propeller shaft 7 is switched by the gear mechanism 6. The propeller 8 rotates in the same direction as the propeller shaft 7. A direction of rotation of the propeller 8 is thus switched between a forward rotation direction and a reverse rotation direction. A direction of the thrust is thus switched.

As shown in FIG. 3, the gear mechanism 6 includes a cylindrical or substantially cylindrical pinion 21 that rotates around the drive axis Ad together with the driveshaft 5, a cylindrical or substantially cylindrical front gear 22 and rear gear 23 engaged with the pinion 21, and a cylindrical or substantially cylindrical dog clutch 24 that selectively engages with one of either of the front gear 22 and the rear gear 23. The outboard motor 2 includes a shift mechanism that moves the dog clutch 24 in an axial direction (front/rear direction) of the propeller shaft 7 to switch a shift state of the gear mechanism 6.

The pinion 21 is coupled to a lower end portion of the driveshaft 5. The driveshaft 5 is inserted in a shaft insertion hole 25 provided in the lower case 20. The driveshaft 5 is supported, via an upper bearing 27 and a lower bearing 28 that surround the driveshaft 5, by the lower case 20 so as to be rotatable around the drive axis Ad. An upper end of the shaft insertion hole 25 is closed by an annular cap 26 that surrounds the driveshaft 25. The upper bearing 27 is disposed below the cap 26 and the lower bearing 28 is disposed below the upper bearing 27. The pinion 21 is disposed below the lower bearing 28.

The front gear 22 is disposed farther to the front than the drive axis Ad. The rear gear 23 is disposed farther to the rear than the drive axis Ad. The dog clutch 24 is disposed between the front gear 22 and the rear gear 23. A front end portion of the propeller shaft 7 is inserted inside the cylindrical or substantially cylindrical front gear 22, rear gear 23, and dog clutch 24. The front gear 22 and the rear gear 23 are supported via bearings by the lower case 20 so as to be rotatable around the propeller axis Ap. When the engine 3 rotates the driveshaft 5, the rotation of the pinion 21 defining a drive gear is transmitted to the front gear 22 and the rear gear 23 defining driven gears and the front gear 22 and the rear gear 23 rotate in mutually opposite directions.

The dog clutch 24 is splined to the propeller shaft 7. The dog clutch 24 is movable in an axial direction of the propeller shaft 7 with respect to the propeller shaft 7 and rotates integrally with the propeller shaft 7 around the propeller axis Ap. The dog clutch 24 includes a front engaging portion 24*a* facing an engaging portion of the front gear 22 and a rear engaging portion 24*b* facing an engaging portion of the rear gear 23. The dog clutch 24 is movable along the propeller shaft 7 in the front/rear direction between a forward rotation position at which the front engaging portion 24*a* engages with the engaging portion of the front gear 22 and a reverse rotation position at which the rear engaging portion 24*b* engages with the engaging portion of the rear gear 23. A position between the forward rotation position and the reverse rotation position is a neutral position (position shown in FIG. 3) at which the dog clutch 24 is not engaged with either of the front gear 22 and the rear gear 23.

The pinion 21, the front gear 22, the rear gear 23, and the dog clutch 24 are disposed inside a gear chamber 30 provided in the torpedo portion 20*a*. The gear chamber 30 is defined by an inner surface of the torpedo portion 20*a*. The gear chamber 30 is filled with a lubricating oil (gear oil) that lubricates the gear mechanism 6. A front end 30*a* of the gear chamber 30 is disposed in front of the front gear 22. The shaft insertion hole 25 is disposed above the gear chamber 30. The shaft insertion hole 25 is connected to the gear chamber 30 via a bypass groove 29 provided around the lower bearing 28. The lubricating oil is movable between the gear chamber 30 and the shaft insertion hole 25 via the bypass groove 29 positioned above the pinion 21.

The shift mechanism positions the dog clutch 24 at one shift position among the forward rotation position, the reverse rotation position, and the neutral position. The shift mechanism includes a shift actuator 31 (see FIG. 1) driven in accordance with a shift operation by a user and a shift rod 32 that is driven to rotate by the shift actuator 31. The shift mechanism further includes a slide shaft 33 driven in the front/rear direction by the shift rod 32 and a coupling pin 34 coupling the slide shaft 33 and the dog clutch 24.

The shift rod 32 includes a rod portion 32*a* extending in the up/down direction, a disk portion 32*b* disposed below the rod portion 32*a*, and a crank portion 32*c* disposed below the rod portion 32*a*. The rod portion 32*a* is inserted in the cylindrical steering shaft 12 and is parallel or substantially parallel to the driveshaft 5. The rod portion 32*a* and the disk portion 32*b* are coaxial and a portion (eccentric portion) of the crank portion 32*c* is eccentric with respect to the rod portion 32*a* and the disk portion 32*b*.

The rod portion 32*a* is disposed inside a shift chamber 35 provided at the lower case 20. The shift chamber 35 extends in the up/down direction along the rod portion 32*a*. The rod portion 32*a* projects upward from an upper end of the shift chamber 35. The rod portion 32*a* is supported, via an annular cap 36 surrounding the rod portion 32*a*, by the lower case 20 so as to be rotatable around a center line of the rod portion 32*a*. The upper end of the shift chamber 35 is closed by the cap 36. A lower end of the shift chamber 35 is closed by the disk portion 32*b*. The shift chamber 35 is positioned above the gear chamber 30. The shift chamber 35 is connected to the gear chamber 30 via a bypass groove 37 disposed around the disk portion 32*b*. The lubricating oil is movable between the gear chamber 30 and the shift chamber 35 via the bypass groove 37.

The lubricating oil that lubricates the gears, bearings, etc., is stored not only in the gear chamber 30 but also in the shift chamber 35. When the engine 3 is stopped and when it is idle, an oil surface of the lubricating oil is positioned inside the shift chamber 35. That is, the entire gear chamber 30 is filled with the lubricating oil and a portion of the shift chamber 35 is filled with the lubricating oil. The gear chamber 30 and the shift chamber 35 define an oil storage chamber that stores the lubricating oil. The oil surface of the lubricating oil is spaced downward from the cap 36. A position (height) of the oil surface of the lubricating oil changes in accordance with a temperature of the lubricating oil.

The slide shaft 33 includes a front shaft 33*a* mounted to the crank portion 32*c* and a rear shaft 33*b* mounted to the coupling pin 34. The rear shaft 33*b* is inserted inside the propeller shaft 7 from the front of the propeller shaft 7, and the front shaft 33*a* extends forward from the rear shaft 33*b*.

The front shaft 33*a* projects forward from a front end of the propeller shaft 7. The crank portion 32*c* is mounted to the front shaft 33*a* at the front of the propeller shaft 7.

When the user operates a shift lever provided at a vessel operator compartment, the shift actuator 31 (see FIG. 1) causes the shift rod 32 to pivot around the center line of the rod portion 32*a*. A portion of the crank portion 32*c* is eccentric with respect to the rod portion 32*a* and therefore when the shift rod 32 pivots, a portion of the crank portion 32*a* moves in the front/rear direction. The front shaft 33*a* is thus pushed forward or rearward by the crank portion 32*c* and moves in the front/rear direction. Accordingly, the rear shaft 33*b*, the coupling pin 34, and the dog clutch 24 move integrally in the front/rear direction. The dog clutch 24 is thus disposed at one position among the forward rotation position, the reverse rotation position, and the neutral position.

As shown in FIG. 3, the outboard motor 2 includes a water cooling apparatus that cools respective portions of the outboard motor 2 including the engine 3. The water cooling apparatus includes a water inlet 38 opening at an outer surface of the outboard motor 2, a cooling water passage 39 that guides the water outside the outboard motor 2 that flowed into the water inlet 38 to the respective portions of the outboard motor 2, and a water pump 40 that generates a suction force that suctions the water outside the outboard motor 2 into the water inlet 38. The water pump 40 that is driven by the engine 3 is disposed on the cooling water passage 39 provided in an interior of the outboard motor 2. The cooling water passage 39 includes a water supply passage 39*a* that guides the water outside the outboard motor 2 to the respective portions of the outboard motor 2 and a drain passage by which the water that has cooled the respective portions of the outboard motor 2 is discharged to outside the outboard motor 2.

The water pump 40 includes an impeller 40*a* that rotates together with the driveshaft 5 and a pump case 40*b* that houses the impeller 40*a*. When the engine 3 rotates the driveshaft 5, the impeller 40*a* rotates with respect to the pump case 40*b*. The pump case 40*b* is connected to the water inlet 38 via the water supply passage 39*a* provided at the lower case 20. When the engine 3 rotates the driveshaft 5, the water outside the outboard motor 2 is suctioned as cooling water from the water inlet 38 and via the water supply passage 39*a* into an interior of the pump case 40*b* and fed to the engine 3, etc., from the pump case 40*b*. The respective portions of the outboard motor 2 are thus cooled.

An oil exchange system that exchanges the lubricating oil inside the outboard motor 2 shall now be described.

Figure 4:
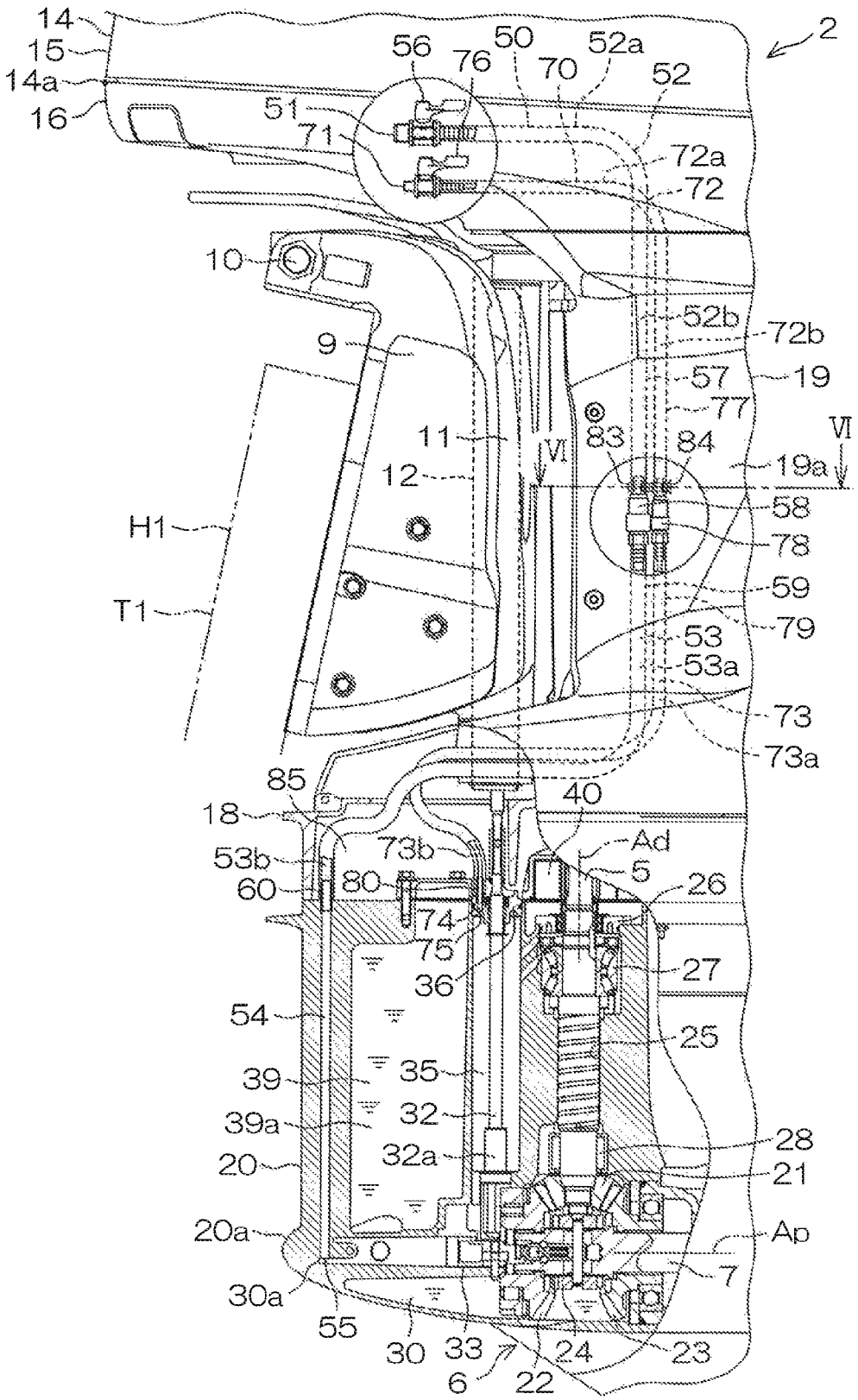
FIG. 4 is a diagram for describing an oil exchange system of the outboard motor.
Figure 5:
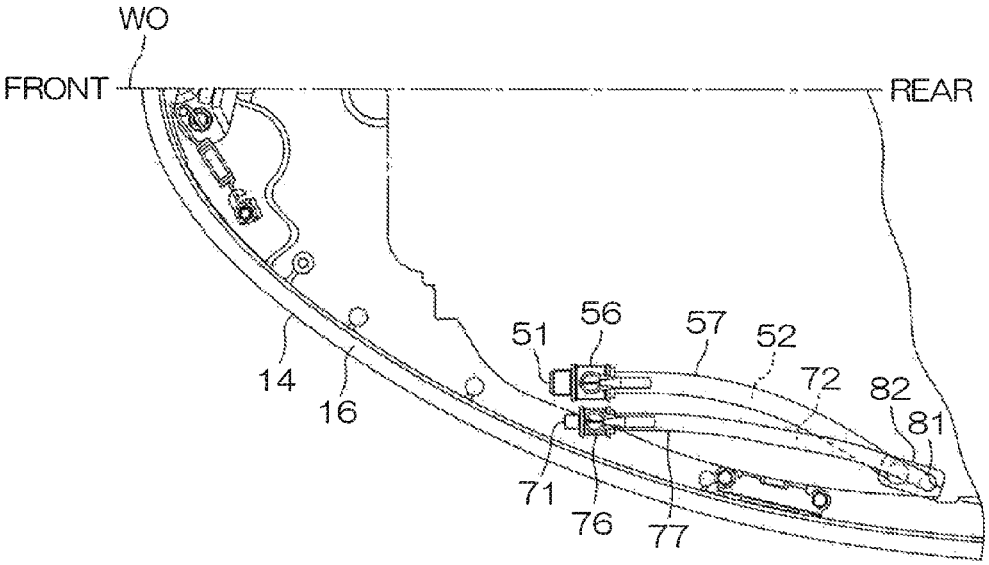
FIG. 5 is a diagram of a bottom cowling as viewed from above.
Figure 6:
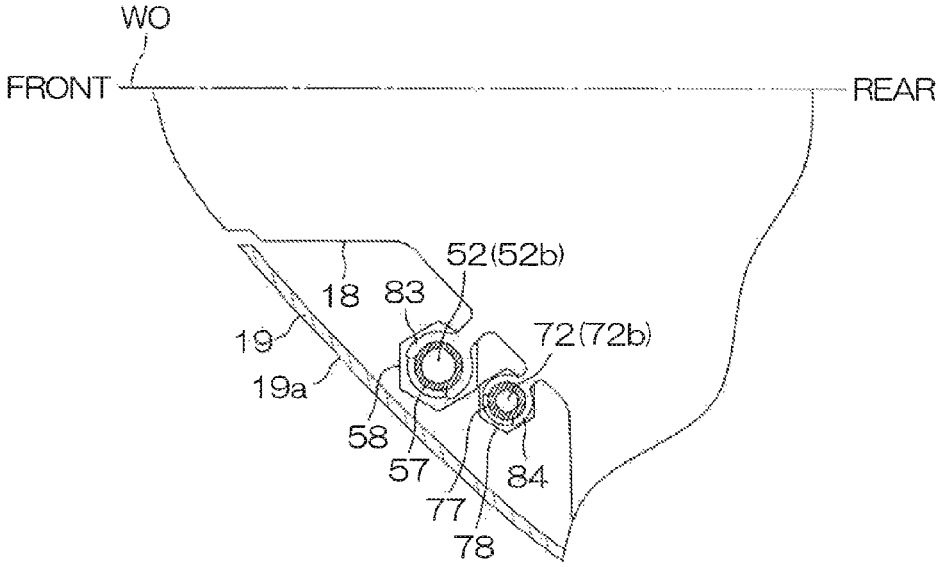
FIG. 6 is a sectional view taken along line VI-VI in FIG. 4.

FIG. 4 is a diagram for describing the oil exchange system of the outboard motor 2. FIG. 5 is a diagram of the bottom cowling 16 as viewed from above. FIG. 6 is a sectional view taken along line VI-VI in FIG. 4.

As shown in FIG. 4, the outboard motor 2 includes an oil passage 50 that guides the lubricating oil and an air passage 70 that guides air. The oil passage 50 includes a lower oil port 55 opening at an inner surface of the gear chamber 30, an upper oil port 51 disposed higher than the lower oil port 55, and an oil passage extending from the lower oil port 55 to the upper oil port 51. The air passage 70 includes a lower air port 75 opening at an inner surface of the shift chamber 35, an upper air port 71 disposed higher than the lower air port 75, and an air passage extending from the lower air port 75 to the upper air port 71.

The upper oil port 51 includes a manual type oil cock 56. The oil passage includes an upper oil passage 52 including an upper oil hose 57, an intermediate oil passage 53 including a lower oil hose 59, and a lower oil passage 54 including a portion of the lower case 20. The upper oil hose 57 and the lower oil hose 59 are preferably flexible members made from an elastic material, such as resin or rubber. One end portion of the upper oil hose 57 is coupled to the oil cock 56. Another end portion of the upper oil hose 57 is coupled to one end portion of the lower oil hose 59 via a cylindrical or substantially cylindrical upper oil joint 58. Another end portion of the lower oil hose 59 is coupled to the lower case 20 via a cylindrical or substantially cylindrical lower oil joint 60 inserted in the lower oil passage 54.

The upper air port 71 includes a manual type air cock 76. The air passage includes an upper air passage 72 including an upper air hose 77, an intermediate air passage 73 including a lower air hose 79, and a lower air passage 74 defined by the cap 36. The upper air hose 77 and the lower air hose 79 are preferably flexible members made from an elastic material, such as resin or rubber. One end portion of the upper air hose 77 is coupled to the air cock 76. Another end portion of the upper air hose 77 is coupled to one end portion of the lower air hose 79 via a cylindrical or substantially cylindrical upper air joint 78. Another end portion of the lower air hose 79 is coupled to the lower case 20 via a cylindrical or substantially cylindrical lower air joint 80 inserted in the lower air passage 74.

The oil cock 56 includes a cylindrical or substantially cylindrical housing defining a portion of the oil passage 50, a valve disposed inside the housing, and a lever movable together with the valve between an open position, at which the oil cock 56 is open, and a closed position, at which the oil cock 56 is closed. Similarly, the air cock 76 includes a cylindrical or substantially cylindrical housing defining a portion of the air passage 70, a valve disposed inside the housing, and a lever movable together with the valve between an open position, at which the air cock 76 is open, and a closed position, at which the air cock 76 is closed. The upper oil port 51 is defined by the housing of the oil cock 56. Similarly, the upper air port 71 is defined by the housing of the air cock 76. The oil cock 56 and the air cock 76 are closed at times other than when the lubricating oil is exchanged.

The upper oil port 51 and the upper air port 71 are disposed inside the cowling 14. The upper oil port 51 and the upper air port 71 are disposed rearward of a front end 14*a* of the cowling 14, that is, a front end of the outboard motor 2. Each of the upper oil port 51 and the upper air port 71 may be disposed at any position, as long as the position is inside the cowling 14. When the outboard motor 2 is positioned at any position from the tilt-down position to the tilt-up position, the upper oil port 51 and the upper air port 71 are positioned higher than the water surface. The upper oil port 51 and the upper air port 71 are disposed at positions farther to the rear than the tilting shaft 10 and farther to the front than the steering shaft 12. The tilting shaft 10 and the clamp brackets 9 are positioned lower than the upper oil port 51 and the upper air port 71.

As shown in FIG. 5, the upper air port 71 is disposed at the same side as the upper oil port 51 with respect to the center WO of the outboard motor 2 in the right/left direction. The upper air port 71 is disposed farther outward in the right/left direction than the upper oil port 51. The upper air port 71 may be disposed farther inward than the upper oil port 51 or may be disposed at the side opposite the upper oil port 51 with respect to the center WO of the outboard motor 2 in the right/left direction. The upper air port 71 may be disposed lower or higher than the upper air port 51 or may be disposed at the same height as the upper oil port 51.

As shown in FIG. 5, the upper oil passage 52 and the upper air passage 72 extend from above the bottom cowling 16 to below the bottom cowling 16 through a hose passage hole 81 penetrating through the bottom cowling 16 in the up/down direction. That is, the upper oil passage 52 and the upper air passage 72 pass through the same hole in the up/down direction. The upper oil passage 52 and the upper air passage 72 may pass through different holes. Portions of the upper oil hose 57 and the upper air hose 77 are held by the bottom cowling 16 via a grommet 82 made of resin or rubber and disposed inside the hose passage hole 81.

As shown in FIG. 4, the upper oil passage 52 includes an upper portion 52*a* disposed inside the cowling 14 and a lower portion 52*b* extending downward from the upper portion 52*a*. Similarly, the upper air passage 72 includes an upper portion 72*a* disposed inside the cowling 14 and a lower portion 72*b* extending downward from the upper portion 72*a*. In a side view, the upper portion 52*a* and the upper portion 72*a* extend from positions in front of the steering shaft 12 to positions to the rear of the steering shaft 12. The lower portion 52*b* and the lower portion 72*b* penetrate through the bottom cowling 16 in the up/down direction. The lower portion 52*b* and the lower portion 72*b* extend in the up/down direction along an outer surface of the upper case 18.

As shown in FIG. 6, the lower portion 52*b* and the lower portion 72*b* are disposed on a lateral side of the upper case 18. The lower portion 72*b* is disposed at the same side as the lower portion 52*b* with respect to the center WO of the outboard motor 2 in the right/left direction. The lower portion 72*b* may be disposed at the side opposite the lower portion 52*b* with respect to the center WO of the outboard motor 2 in the right/left direction. The upper oil hose 57 and the upper air hose 77 are positioned between the outer surface of the upper case 18 and an inner surface of the apron 19 and are exposed at the outer surface of the upper case 18. The upper oil hose 57 and the upper air hose 77 are adjacent each other at a lateral side of the upper case 18. A shortest distance in a horizontal direction from an outer peripheral surface of the upper oil hose 57 to an outer peripheral surface of the upper air hose 77 is less than an outer diameter of the upper oil hose 57 and less than an outer diameter of the upper air hose 77.

A lower end portion of the upper oil hose 57 is held by an oil hose holder 83 with, for example, a C-shaped cross section. Similarly, a lower end portion of the upper air hose 77 is held by an air hose holder 84 with, for example, a C-shaped cross section. The oil hose holder 83 and the air hose holder 84 project sideward from the outer surface of the upper case 18. The oil hose holder 83 and the air hose holder 84 are fixed to the upper case 18. The oil hose holder 83 may be integral and unitary with the upper case 18 or may be a separate member from the upper case 18. The same applies to the air hose holder 84.

As shown in FIG. 4, the intermediate oil passage 53 includes an upper portion 53*a* extending downward from the upper oil passage 52 and a lower portion 53*b* extending forward from the upper portion 53*a*. Similarly, the intermediate air passage 73 includes an upper portion 73*a* extending downward from the upper air passage 72 and a lower portion 73*b* extending forward from the upper portion 73*a*. The upper portion 53*a* and the upper portion 73*a* extend in the up/down direction between the upper case 18 and the apron 19. The lower portion 53*b* and the lower portion 73*b* extend from positions to the rear of the steering shaft 12 to positions in front of the steering shaft 12. Lower end portions of the lower portion 53*b* and the lower portion 73*b* are disposed in an interior 85 of the upper case 18.

The lower oil passage 54 is disposed in an interior of the lower case 20. The lower oil passage 54 is preferably integral and unitary with the lower case 20. The lower oil passage 54 is made by, for example, casting or drilling. The lower oil passage 54 is positioned in front of the water supply passage 39*a* that is a portion of the cooling water passage 39. The shift rod 32 and the driveshaft 5 are positioned to the rear of the lower oil passage 54. The lower oil passage 54 is disposed at the center WO of the outboard motor 2 in the right/left direction.

An upper end of the lower oil passage 54 opens at an upper surface of the lower case 20. A lower end of the lower oil passage 54 opens at the inner surface of the gear chamber 30. The lower oil passage 54 defines a rectilinear longitudinal passage extending in the up/down direction inside the lower case 20. The lower oil passage 54 may be vertical from its upper end to its lower end or may be inclined obliquely with respect to a vertical direction. Also, the lower oil passage 54 may have a broken line shape or a curved shape, for example.

The lower air passage 74 is defined by the cap 36. An upper end of the lower air passage 74 opens at an upper surface of the cap 36. A lower end of the lower air passage 74 opens at a lower surface of the cap 36 that defines the shift chamber 35. The lower end of the lower air passage 74 is positioned inside the lower case 20. The lower air passage 74 is shorter than the lower oil passage 54 in the vertical direction. The lower air passage 74 is positioned above the shift chamber 35. The lower air passage 74 is disposed in front of the shift rod 32. The lower air passage 74 is disposed to the rear of the water supply passage 39*a*. The lower air passage 74 is positioned below the steering shaft 12. The lower air passage 74 is disposed at the center WO of the outboard motor 2 in the right/left direction.

The lower oil port 55 corresponds to the lower end of the lower oil passage 54. The lower oil port 55 is disposed close to the front end 30*a* of the gear chamber 30. The lower oil port 55 faces downward. The lower oil port 55 is disposed in front of the slide shaft 33. The lower oil port 55 is disposed lower than the pinion 21. The lower oil port 55 is disposed at the same height as portions of the front gear 22 and the rear gear 23. The lower oil port 55 is disposed below the propeller axis Ap. The lower oil port 55 may be disposed on the propeller axis Ap or may be disposed above the propeller axis Ap. The lower oil port 55 is disposed farther to the front than a front end of the water supply passage 39*a*. The lower oil port 55 is disposed at the center WO of the outboard motor 2 in the right/left direction.

The lower air port 75 corresponds to the lower end of the lower air passage 74. The lower air port 75 faces downward. The lower air port 75 is positioned around the shift rod 32. The lower air port 75 is disposed below the steering shaft 12. The lower air port 75 is disposed at a position lower than the water pump 40 and higher than an upper end of the upper bearing 27. The lower air port 75 is positioned to the rear of the water supply passage 39*a*. The front gear 22 is positioned farther to the rear than the lower air port 75. The lower air port 75 is disposed at a position farther to the rear than the lower oil port 55 and higher than the lower oil port 55.

Flow passage areas of respective portions of the air passage 70 are smaller than flow passage areas of respective portions of the oil passage 50. For example, as shown in FIG. 5, an opening area of the upper air port 71 is smaller than an opening area of the upper oil port 51. As shown in FIG. 6, a cross-sectional area of the upper air passage 72 is smaller than a cross-sectional area of the upper oil passage 52. A viscosity of the lubricating oil is higher than a viscosity of air. If the flow passage area is small, the lubricating oil cannot flow readily and a high pressure (suction pressure or supply pressure) must thus be applied to the oil passage 50. The flow passage areas of the oil passage 50 are thus large, and the pressure applied to the oil passage 50 when the lubricating oil is made to flow through the oil passage 50 is thus reduced.

When the outboard motor 2 is positioned at the tilt-down position as shown in FIG. 3 and FIG. 4, the lower oil port 55 is disposed close to the front end 30*a* of the gear chamber 30. The front end 30*a* of the gear chamber 30 corresponds to a front end of the oil storage chamber that includes the gear chamber 30 and the shift chamber 35. When the outboard motor 2 is tilted up to the tilt-up position as shown in FIG. 2, the front end 30*a* of the gear chamber 30 is moved to a lowermost end of the oil storage chamber.

An oil exchanging method to exchange the lubricating oil inside the outboard motor 2 shall now be described.

FIG. 7 to FIG. 10 are schematic views for describing an oil exchanging method according to a preferred embodiment of the present invention.

Figure 7:
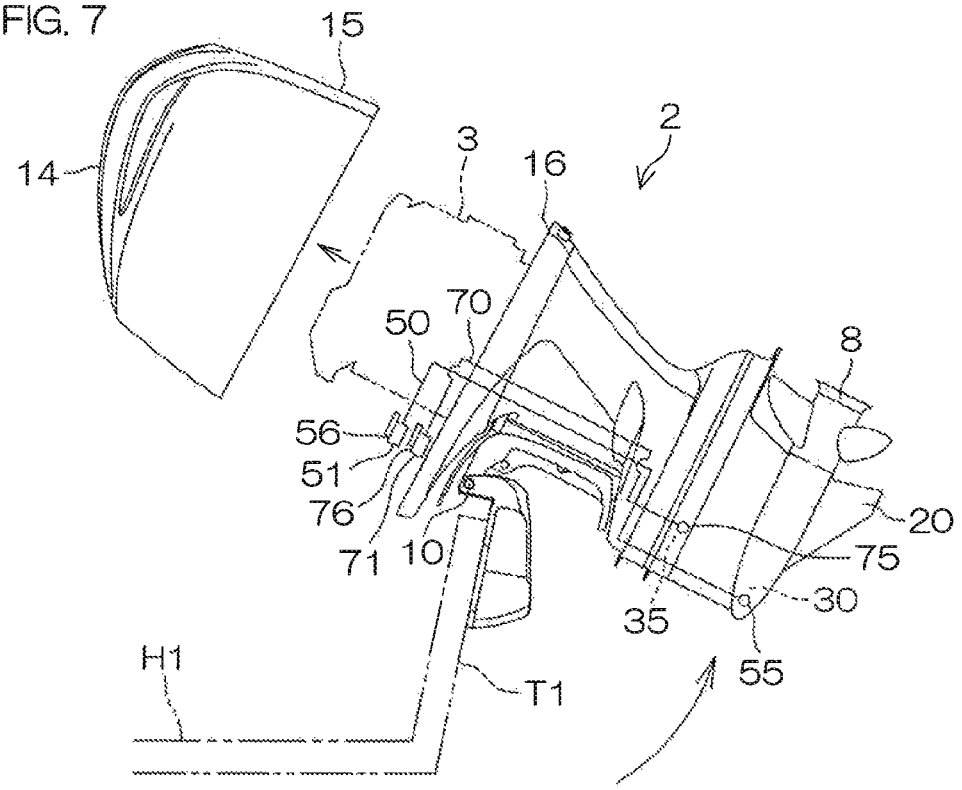
FIG. 7 is a schematic view for describing an oil exchanging method according to a preferred embodiment of the present invention.

When the lubricating oil inside the outboard motor 2 is to be exchanged, an up/down switch provided at the outboard motor 2 or the vessel operator compartment is operated to raise a lower portion of the outboard motor 2 until the outboard motor 2 moves to the tilt-up position as shown in FIG. 7. Thereafter, the top cowling 15 is removed to expose the oil cock 56 and the air cock 76. The tilting up of the outboard motor 2 may be performed after the top cowling 15 has been removed.

Figure 8:
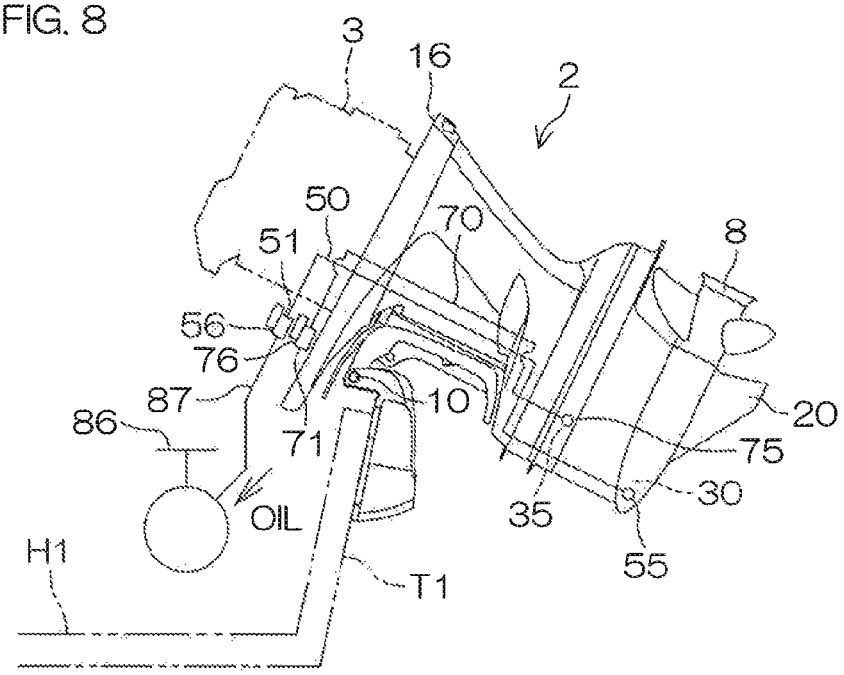
FIG. 8 is a schematic view for describing the oil exchanging method according to a preferred embodiment of the present invention.

Next, as shown in FIG. 8, an end portion of a connection hose 87 extending from a manual type or electrically driven type suction pump 86 is mounted to the oil cock 56 to connect the oil cock 56 to the suction pump 86 disposed on board. Further, the levers of the oil cock 56 and the air cock 76 are moved from the closed positions to the open positions to open the oil cock 56 and the air cock 76. Thereafter, the suction pump 86 is operated to make the suction pump 86 suction the lubricating oil inside the outboard motor 2.

The lubricating oil inside the gear chamber 30 is suctioned from the lower oil port 55 into the oil passage 50 and is discharged toward the suction pump 86 from the upper oil port 51. At the same time, air outside the outboard motor 2 is suctioned into the air passage 70 from the upper air port 71 that is open to the atmosphere and is discharged into the shift chamber 35 from the lower air port 75. The lubricating oil inside the gear chamber 30 is thus suctioned continuously by the suction pump 86.

When the outboard motor 2 is disposed at the tilt-up position, the lower oil port 55 is positioned close to the lowermost end of the oil storage chamber (see FIG. 2). Therefore, all or nearly all of the lubricating oil is discharged from the oil storage chamber. When all of the lubricating oil inside the outboard motor 2 is removed or nearly removed, air bubbles become mixed in the lubricating oil flowing inside the transparent connection hose 87. Thereafter, nearly all of the lubricating oil is removed from the connection hose 87. The lubricating oil inside the oil storage chamber including the gear chamber 30 and the shift chamber 35 is thus discharged into the suction pump 86.

Figure 9:
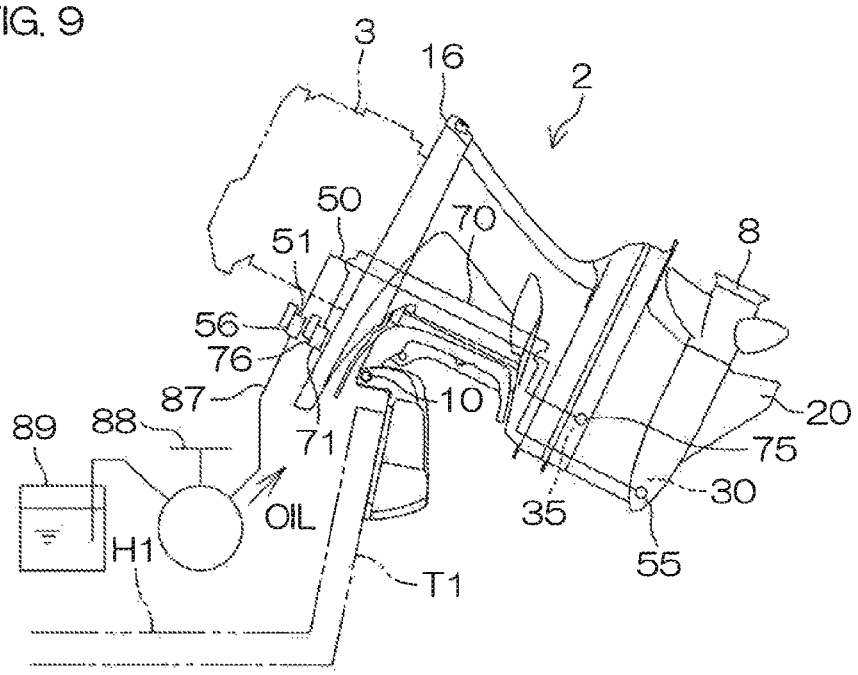
FIG. 9 is a schematic view for describing the oil exchanging method according to a preferred embodiment of the present invention.

After the used lubricating oil has been discharged, the suction pump 86 is removed from the connection hose 87 and a supply pump 88, disposed on board, is mounted to the connection hose 87 as shown in FIG. 9. Thereafter, fresh lubricating oil inside an oil tank 89, disposed on board, is fed to the oil cock 56 by the supply pump 88. The supply pump 88 may be of a manual type or an electrically driven type and may be the same pump as the suction pump 86.

The fresh lubricating oil inside the oil tank 89 enters inside the oil passage 50 from the upper oil port 51 and is supplied to the gear chamber 30 from the lower oil port 55. At the same time, the air inside the shift chamber 35 enters inside the air passage 70 from the lower air port 75 and is discharged from the upper air port 71. When the supplied amount of the lubricating oil reaches a prescribed amount, that is, when the oil surface of the lubricating oil supplied from the lower oil port 55 rises to the lower air port 75, the oil is discharged from the upper air port 71. A drain hose may be mounted to the air cock 76 to guide the oil discharged from the upper air port 71 to a drain tank disposed on board.

Figure 10:
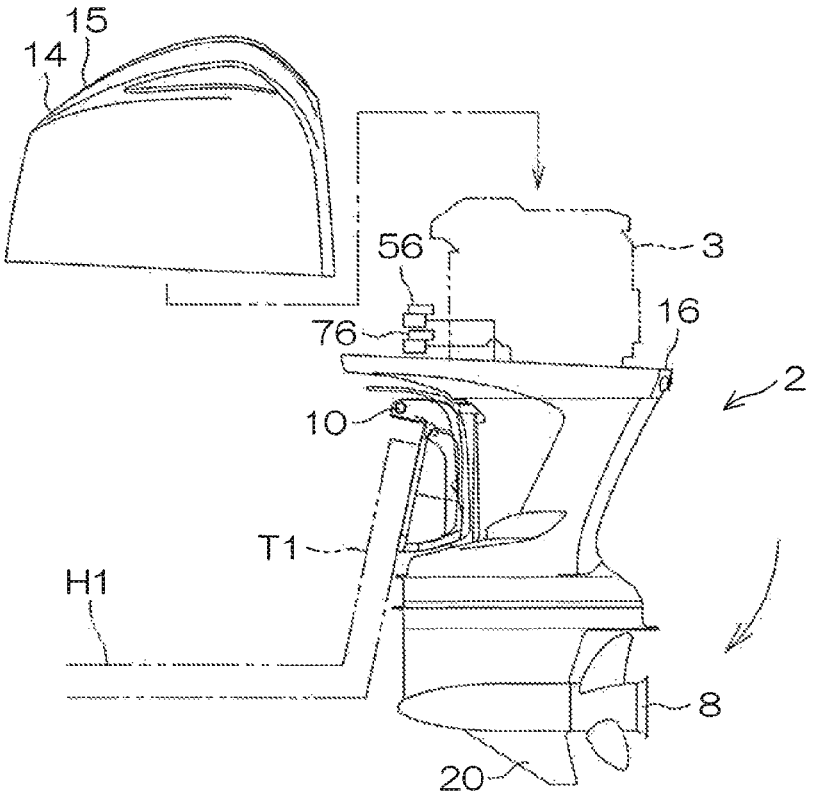
FIG. 10 is a schematic view for describing the oil exchanging method according to a preferred embodiment of the present invention.

After the prescribed amount of oil has been supplied to the outboard motor 2, the oil cock 56 and the air cock 76 are closed and the connection hose 87 is removed from the oil cock 56. Thereafter, the top cowling 15 is mounted to the bottom cowling 16 as shown in FIG. 10. Subsequently, the up/down switch is operated to tilt down the outboard motor 2. The mounting of the top cowling 15 may be performed after the outboard motor 2 has been tilted down. The lubricating oil inside the outboard motor 2 is thus exchanged.

As described above, with the present preferred embodiment, the lower oil port 55 of the oil passage 50 opens at the oil storage chamber that includes the gear chamber 30 and the shift chamber 35. The upper oil port 51 of the oil passage 50 is disposed higher than the lower case 20. When the lubricating oil inside the oil storage chamber is to be discharged, the suction pump 86 is connected to the upper oil port 51. The lubricating oil inside the oil storage chamber is made to flow, by the suction force of the suction pump 86, from the lower oil port 55 to the upper oil port 51 via the lower oil passage 54 extending in the up/down direction inside the lower case 20. The lubricating oil inside the oil storage chamber is thus discharged.

The upper oil port 51 is disposed higher than the lower case 20 and therefore, in comparison to a case where it is provided at the lower case 20, the upper oil port 51 is close to the engine 3. In other words, the upper oil port 51 is close to a user on board. The user thus connects the suction pump 86 to the upper oil port 51 without disembarking from the vessel. The user thus exchanges the lubricating oil inside the outboard motor 2 included in the vessel without disembarking from the vessel afloat on the water surface.

Further, the longitudinal passage of the oil passage 50 is provided in the interior of the lower case 20 that is disposed underwater and therefore the application of resistance from the water on the longitudinal passage is prevented. The outboard motor 2 is thus provided with the oil passage 50 while preventing the lowering of propulsion efficiency. Moreover, the lubricating oil readily flows smoothly through the oil passage 50 because the longitudinal passage extends in the up/down direction. Time required for the exchange of the lubricating oil is thus shortened.

With the present preferred embodiment, the upper oil port 51 of the oil passage 50 is disposed higher than an upper end of the upper case 18 and therefore the upper oil port 51 is even closer to the user on board. The upper end of the upper case 18 is ordinarily positioned above the water surface. The upper oil port 51 is thus ordinarily disposed above the water surface. A user on board is thus able to access the upper oil port 51 easily without putting his/her hand underwater.

With the present preferred embodiment, the upper oil port 51 of the oil passage 50 is disposed higher than the tilting shaft 10 and therefore the upper oil port 51 is even closer to the user on board. The tilting shaft 10 is ordinarily positioned higher than an upper end of the transom T1 provided at the rear portion of the hull H1. The upper oil port 51 is thus disposed higher than the upper end of the transom T1. The user on board is thus able to access the upper oil port 51 easily without lowering his/her hand to a position lower than the upper end of the transom T1.

With the present preferred embodiment, not only the engine 3 but the upper oil port 51 is also housed in the cowling 14. The user on board is able to access the upper oil port 51 easily by opening the cowling 14. Further, when the cowling 14 is closed, the upper oil port 51 is protected by the cowling 14, so that water spray is unlikely to adhere to the upper oil port 51. The upper oil port 51 is thus prevented from being soiled with brine, dust, etc.

With the present preferred embodiment, the upper oil port 51 is positioned farther to the rear than the front end 14*a* of the cowling 14, that is, the front end of the outboard motor 2. When the upper oil port 51 is positioned farther to the front than the front end of the outboard motor 2, a portion of the oil passage 50 is disposed on board. This means that the on board space usable by the user is decreased. The decrease of on board space is thus prevented by positioning the upper oil port 51 farther to the rear than the front end 14*a* of the cowling 14.

With the present preferred embodiment, when the outboard motor 2 is tilted up to the tilt-up position, that is, when the lower case 20 is disposed above the water surface, the lower oil port 55 is disposed at or in a vicinity of the lowermost end of the oil storage chamber. All of the lubricating oil inside the oil storage chamber flows toward the lowermost end of the oil storage chamber due to gravity. A residual amount of the lubricating oil when the lubricating oil is discharged from the oil storage chamber is thus reduced.

With the present preferred embodiment, at least a portion of the upper oil hose 57 is disposed outside the upper case 18. A space to house the upper oil hose 57 thus does not have to be provided in the interior 85 of the upper case 18. Further, at least a portion of the upper case 18 is disposed above the water surface, so that the upper oil hose 57 is exposed at the outer surface of the upper case 18 while preventing an increase in the resistance applied to the outboard motor 2 from the water.

With the present preferred embodiment, the upper oil hose 57 is held at the outer surface of the upper case 18 by the oil hose holder 83. The position of the upper oil hose 57 is thus stabilized. The upper oil hose 57 is thus prevented from rubbing or colliding against another member when the vessel is traveling. Damage to the upper oil hose 57, which is softer than the upper case 18 that is typically made of metal, is thus prevented.

With the present preferred embodiment, the upper oil hose 57 and the lower oil hose 59 are disposed between the upper case 18 and the apron 19, so that the upper oil hose 57 and the lower oil hose 59 are covered by the inner surface of the apron 19. The upper oil hose 57 and the lower oil hose 59 are prevented from being hit by an obstacle on the water surface or underwater because the upper oil hose 57 and the lower oil hose 59 are protected by the apron 19. Damage to the upper oil hose 57 and the lower oil hose 59 is thus prevented.

With the present preferred embodiment, not only the lower oil port 55 but the lower air port 75 also opens at the oil storage chamber. When the lubricating oil inside the oil storage chamber is to be discharged, air flowing into the air passage 70 from the upper air port 71 is supplied from the lower air port 75 to the oil storage chamber at the same time as the lubricating oil is suctioned into the oil passage 50 from the lower oil port 55. When the lubricating oil is to be supplied to the oil storage chamber, the air inside the oil storage chamber is discharged into the air passage 70 from the lower air port 75 at the same time as the lubricating oil is supplied to the oil storage chamber from the lower oil port 55.

The lower air port 75 is positioned higher than the lower oil port 55. The lubricating oil is heavier than air and therefore moves downward in the oil storage chamber. The lower air port 75 is thus unlikely to be clogged by the lubricating oil. Therefore, it is unlikely for the entry and exit of air with respect to the lower air port 75 to be obstructed by the lubricating oil. Further, the upper air port 71 is positioned higher than the lower case 20 and the upper air port 71 is thus closer to the user on board. The user is thus able to operate the air cock 76 that opens and closes the upper air port 71 without disembarking from the vessel afloat on the water surface.

With the present preferred embodiment, the upper air hose 77 is disposed on the outer surface of the upper case 18. In other words, at least a portion of the upper air hose 77 is disposed outside the upper case 18. A space to house the upper air hose 77 thus does not have to be provided in the interior 85 of the upper case 18. Further, at least a portion of the upper case 18 is disposed above the water surface, so that the upper air hose 77 is exposed at the outer surface of the upper case 18 while preventing an increase in the resistance applied to the outboard motor 2 from the water.

Other Preferred Embodiments

The present invention is not restricted to the contents of the preferred embodiments described above and various modifications are possible within the scope of the present invention.

For example, with the preferred embodiments described above, an example where a portion (lower oil passage 54) of the oil passage 50 is disposed inside the lower case 20 and a portion (lower air passage 74) of the air passage 70 is disposed inside the lower case 20 was described. However, the lower oil passage 54 may be disposed outside the lower case 20. The same applies to the lower air passage 74.

With the preferred embodiments described above, an example where the upper oil port 51 and the upper air port 71 are positioned higher than the tilting shaft 10 and the upper case 18 was described. However, at least one of either of the upper oil port 51 and the upper air port 71 may be disposed lower than the tilting shaft 10 and the upper case 18. For example, at least one of either of the upper oil port 51 and the upper air port 71 may be disposed on the lateral side of the upper case 18.

With the preferred embodiments described above, an example where the upper oil port 51 and the upper air port 71 are positioned inside the cowling 14 was described. That is, an example where the upper oil port 51 and the upper air port 71 are disposed at an interior of the outboard motor 2 was described. However, at least one of either of the upper oil port 51 and the upper air port 71 may be disposed at an exterior of the outboard motor 2.

With the preferred embodiments described above, an example where the lower oil port 55 is positioned close to the lowermost end of the oil storage chamber (lowermost end of the gear chamber 30) when the outboard motor 2 is positioned at the tilt-up position was described. However, the lower oil port 55 may be positioned at a position other than the lowermost end of the oil storage chamber.

With the preferred embodiments described above, an example where portions of the upper oil hose 57 and the lower oil hose 59 are exposed at the outer surface of the upper case 18 and portions of the upper air hose 77 and the lower air hose 79 are exposed at the outer surface of the upper case 18 was described. However, the entire upper oil hose 57 may be disposed in the interior of the outboard motor 2. The same applies to the other hoses.

With the preferred embodiments described above, an example where the lower air port 75 is positioned farther to the rear than the lower oil port 55 was described. However, the lower air port 75 may be positioned directly above the lower oil port 55 or may be disposed farther to the front than the lower oil port 55.

Also, features of two or more of the various preferred embodiments described above may be combined.

The present application claims priority to Japanese Patent Application No. 2015-210877 filed on Oct. 27, 2015 in the Japan Patent Office, and the entire disclosure of which is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a driveshaft extending in an up/down direction below the engine and to which a rotation of the engine is transmitted;

a gear mechanism coupled to a lower end of the driveshaft and to which a rotation of the driveshaft is transmitted;

a propeller shaft to which a rotation of the gear mechanism is transmitted;

a cowling housing the engine;

an upper case disposed below the engine and housing the driveshaft;

a lower case disposed below the upper case and defining an oil storage chamber housing the gear mechanism and a lubricating oil; and an oil passage including a lower oil port opening at the oil storage chamber, an upper oil port positioned higher than the lower case, and a longitudinal passage extending in the up/down direction inside the lower case, the oil passage guiding the lubricating oil between the lower oil port and the upper oil port via the longitudinal passage; wherein the upper oil port discharges the lubricating oil from the outboard motor and is fed the lubricating oil in order to supply the lubricating oil to the outboard motor.

2. An outboard motor comprising:

an engine;

a driveshaft extending in an up/down direction below the engine and to which a rotation of the engine is transmitted;

a gear mechanism coupled to a lower end of the driveshaft and to which a rotation of the driveshaft is transmitted;

a propeller shaft to which a rotation of the gear mechanism is transmitted;

a cowling housing the engine;

an upper case disposed below the engine and housing the driveshaft;

a lower case disposed below the upper case and defining an oil storage chamber housing the gear mechanism and a lubricating oil; and an oil passage including a lower oil port opening at the oil storage chamber, an upper oil port positioned higher than the lower case, and a longitudinal passage extending in the up/down direction inside the lower case, the oil passage guiding the lubricating oil between the lower oil port and the upper oil port via the longitudinal passage; wherein the upper oil port is disposed higher than the upper case.

3. The outboard motor according to claim 1, wherein the outboard motor is rotatable around a horizontal tilting shaft; and the upper oil port is positioned higher than the tilting shaft.

4. The outboard motor according to claim 1, wherein the upper oil port is positioned inside the cowling.

5. The outboard motor according to claim 1, wherein the upper oil port is positioned rearward of a front end of the cowling.

6. The outboard motor according to claim 1, wherein the outboard motor is rotatable around a horizontal tilting shaft between a tilt-down position at which the lower case is positioned underwater and a tilt-up position at which the lower case is positioned above a water surface; and the lower oil port is positioned at or adjacent to a lowermost end of the oil storage chamber when the outboard motor is positioned at the tilt-up position.

7. The outboard motor according to claim 1, wherein a portion of the oil passage is integral and unitary with the lower case.

8. The outboard motor according to claim 1, wherein at least a portion of the oil passage includes an oil hose.

9. An outboard motor comprising:

an engine;

a driveshaft extending in an up/down direction below the engine and to which a rotation of the engine is transmitted;

a gear mechanism coupled to a lower end of the driveshaft and to which a rotation of the driveshaft is transmitted;

a propeller shaft to which a rotation of the gear mechanism is transmitted;

a cowling housing the engine;

an upper case disposed below the engine and housing the driveshaft;

a lower case disposed below the upper case and defining an oil storage chamber housing the gear mechanism and a lubricating oil; and an oil passage including a lower oil port opening at the oil storage chamber, an upper oil port positioned higher than the lower case, and a longitudinal passage extending in the up/down direction inside the lower case, the oil passage guiding the lubricating oil between the lower oil port and the upper oil port via the longitudinal passage; wherein at least a portion of the oil passage includes an oil hose; and the oil hose is exposed at an outer surface of the upper case.

10. The outboard motor according to claim 9, further comprising an oil hose holder that holds the oil hose at the outer surface of the upper case.

11. The outboard motor according to claim 10, wherein the oil hose holder is positioned on a lateral side of a center of the outboard motor in a right/left direction.

12. The outboard motor according to claim 9, further comprising:

an apron that covers the outer surface of the upper case; wherein the oil hose is positioned between the outer surface of the upper case and an inner surface of the apron.

13. The outboard motor according to claim 1, further comprising:

an air passage including a lower air port positioned higher than the lower oil port and opening at the oil storage chamber, and an upper air port positioned higher than the lower case; wherein the air passage guides air between the lower air port and the upper air port.

14. The outboard motor according to claim 13, wherein the lower air port is positioned rearward of the lower oil port.

15. The outboard motor according to claim 13, wherein at least a portion of the air passage includes an air hose.

16. The outboard motor according to claim 15, wherein the air hose is exposed at the outer surface of the upper case.

* * * * *